US007827648B2

(12) United States Patent
Soller et al.

(10) Patent No.: US 7,827,648 B2
(45) Date of Patent: Nov. 9, 2010

(54) CLEANING BRUSH WITH DISPOSABLE/REPLACEABLE BRUSH HEAD

(75) Inventors: Douglas A. Soller, Racine, WI (US); Kenneth W. Michaels, Spring Grove, IL (US); Elias H. Shaer, San Antonio, TX (US); Michael J. Banco, Racine, WI (US); Terra J. Morgan, Hales Corner, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 11/532,925

(22) Filed: Sep. 19, 2006

(65) Prior Publication Data

US 2007/0006412 A1 Jan. 11, 2007

Related U.S. Application Data

(63) Continuation of application No. 10/615,178, filed on Jul. 8, 2003, now Pat. No. 7,159,265.

(51) Int. Cl.
*A47K 11/10* (2006.01)

(52) U.S. Cl. ..... 15/104.93; 15/226; 15/209.1; 15/210.1

(58) Field of Classification Search . 15/104.93–104.94, 15/209.1–210.1, 228, 229.1–229.7, 223, 15/226
See application file for complete search history.

(56) References Cited

U.S. PATENT DOCUMENTS 1,767,313 A * 6/1930 Salvucci ..... 15/187
1,993,215 A 3/1935 Hoyt et al.
2,265,102 A * 12/1941 Cressler et al. ..... 15/167.1
2,428,306 A 9/1947 Beagle
2,514,496 A 7/1950 Jones et al.
2,666,223 A 1/1954 Farrell
2,666,224 A 1/1954 Adams
2,813,286 A 11/1957 Strader
3,298,507 A * 1/1967 Micciche ..... 206/361
3,383,158 A 5/1968 Leland
3,495,918 A 2/1970 Leland
3,827,099 A 8/1974 Allaire et al.
3,874,021 A 4/1975 Jacobs
3,896,518 A * 7/1975 Von Post et al. ..... 15/104.94
4,031,673 A 6/1977 Hagelberg
4,117,187 A 9/1978 Adams et al.
4,441,228 A 4/1984 Marquart et al.
4,523,347 A * 6/1985 Tames ..... 15/104.94
4,755,421 A 7/1988 Manning et al.
4,852,201 A 8/1989 Wundrock et al.

(Continued)

FOREIGN PATENT DOCUMENTS

CN 2111727 U 8/1992

(Continued)

*Primary Examiner*—Laura C Guidotti

(57) ABSTRACT

Disclosed is a cleaning brush for cleaning toilet bowls and the like. The brush has a permanent handle and replaceable/disposable brush heads that are flushable after each cleaning. The brush is a stack of sheets of water-dissolvable and/or agitation-dissolvable material. The sheets can be attached together at an end by pressure bonding or by a water-soluble adhesive and formed with bristles at an opposite end. The wand provides a remote system for clamping and unclamping the brush head.

8 Claims, 9 Drawing Sheets

U.S. PATENT DOCUMENTS

| | | | | |
|---|---|---|---|---|
| 4,987,634 | A | 1/1991 | Weihrauch | |
| 5,159,735 | A * | 11/1992 | Owens et al. | 15/104.94 |
| 5,264,269 | A * | 11/1993 | Kakiuchi et al. | 428/156 |
| 5,560,070 | A | 10/1996 | Reaume | |
| 5,624,269 | A * | 4/1997 | Kanamori | 439/83 |
| 5,630,243 | A | 5/1997 | Federico et al. | |
| 6,037,036 | A * | 3/2000 | Febel | 428/132 |
| 6,094,771 | A | 8/2000 | Egolf et al. | |
| 6,336,242 | B1 * | 1/2002 | Tseng | 15/167.1 |
| 6,368,003 | B1 | 4/2002 | Sorrell | |
| 6,745,427 | B1 | 6/2004 | Trenz et al. | |
| 6,978,508 | B2 | 12/2005 | Young | |
| 2003/0126710 | A1 * | 7/2003 | Policicchio et al. | 15/228 |
| 2004/0129296 | A1 | 7/2004 | Treacy et al. | |
| 2004/0187243 | A1 | 9/2004 | Trenz et al. | |

FOREIGN PATENT DOCUMENTS

| | | |
|---|---|---|
| DE | 941153 | 4/1956 |
| DE | 297 03 188 | 7/1997 |
| DE | 202 16 059 | 1/2003 |
| EP | 313495 | 4/1989 |
| EP | 1183980 | 3/2002 |
| GB | 2329325 | 3/1999 |
| GB | 2362565 | 11/2001 |
| JP | 61-268223 | 11/1986 |
| JP | 1-190325 | 7/1989 |
| JP | 09-24010 | 1/1997 |
| JP | 10-295610 | 11/1998 |
| JP | 2000-254060 | 9/2000 |
| JP | 2000-262455 | 9/2000 |
| JP | 2001-78943 | 3/2001 |

* cited by examiner 10
11
60

10
30
60
11
27

40
36
34
7
7

FIG. 10
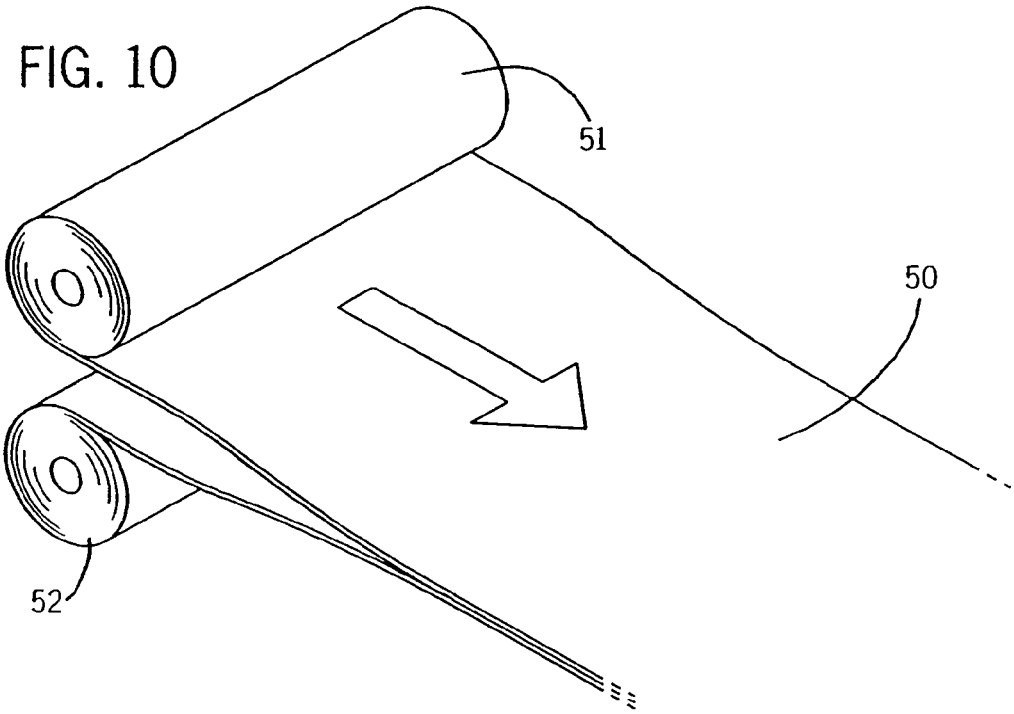
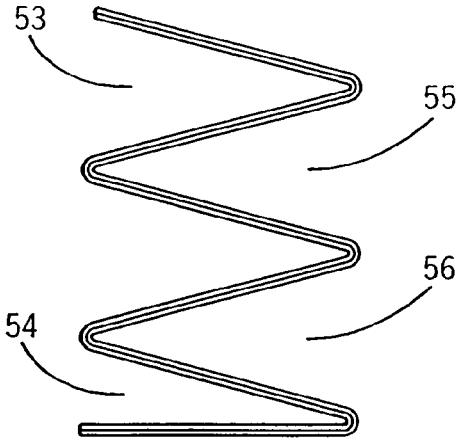
FIG. 11
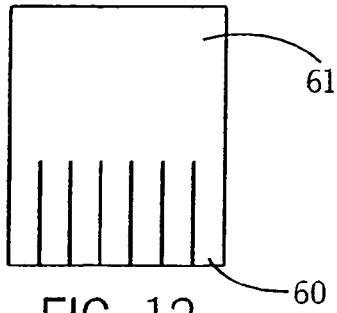
FIG. 12
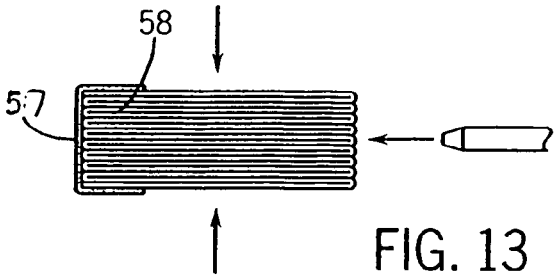
FIG. 13

CLEANING BRUSH WITH DISPOSABLE/REPLACEABLE BRUSH HEAD

CROSS-REFERENCE TO RELATED APPLICATIONS

This application claims priority based on, and is a continuation of, U.S. application Ser. No. 10/615,178, filed Jul. 8, 2003.

STATEMENT REGARDING FEDERALLY SPONSORED RESEARCH

Not Applicable

FIELD OF THE INVENTION

The present invention relates to brushes that are used for cleaning. It appears particularly well suited for providing a toilet brush.

BACKGROUND OF THE INVENTION

Toilet brushes are typically used to swirl cleaning chemicals around a toilet bowl, and then to scrub the sides of the bowl with those chemicals or water, so as to assist in removing stains along the bowl sides. Typically such brushes have their brush bristles permanently affixed to the handle of the brush.

While these brushes do help clean toilets, there is a problem with regard to storing them between uses. After using such a brush a consumer will typically attempt to rinse off the brush by swirling it in bowl water. In some cases this rinsing process will be repeated through several rinsing flushes. While this rinses off most of the cleaning chemicals, feces, urine, and stray bits of paper typically found in the toilet, the brush still normally retains some contaminants even after extensive rinsing. As a result, the brush may develop an unpleasant smell or appearance during storage.

Regardless of whether contaminating materials are present on the stored brush, the brush will be dripping wet immediately after it is used. The consumer may therefore try to shake the brush over the toilet to try to remove most of the excess water, and then quickly move the brush over and then into a storage bucket or the like. However, this can still result in some dripping of liquid on the floor as the wet brush is moved from above the bowl to a bucket or similar storage container. In any event, this requires a consumer to obtain and find a storage place for that bucket or storage container.

To try to overcome such problems the art designed a variety of assemblies in which a permanent brush handle was provided, but the brush head was formed as a disposable and replaceable element. See for example U.S. Pat. Nos. 4,031,673, 5,471,697, 4,987,634, and 6,094,771. See also PCT application WO 01/15587.

Some of these devices designed the disposable brush head as a small biodegradable head that could be flushed down the toilet after use. Some also impregnated the replaceable head with a cleaning composition to avoid the need to separately add a cleaning chemical.

However, some of these devices relied on relatively weak frictional attachments to connect the replaceable brush head to the wand or handle. The head could accidentally and prematurely fall off during use before the cleaning was complete (for example during vigorous scrubbing of a stubborn stain).

Also, certain types of such brush heads could cause clogging problems with sensitive toilets, or be unsuitable for use with sensitive septic systems. This might be due to the size of the head, or to extra structures such as bands used to hold head parts together.

To try to avoid this, some formed their brush heads from extremely water-degradable material. Unfortunately, because that material was so water-degradable it sometimes began to fall apart before the cleaning process was done, particularly when aggressive scrubbing was attempted. For example, the Hygenihouse brush head was so degradable that their use instructions cautioned that the portion of the bowl above the water level needed to be cleaned first, indicating that if one washed the portion of the bowl below the water line first the brush head would disintegrate before scrubbing above the water line could be completed.

Another deficiency of the prior art was that many of these devices relied on relatively long handles (so as to provide a brush about the size of a conventional toilet bowl brush). This took up quite a bit of space, thereby rendering the device less likely to be acceptable to some retailers, and, in any event increasing the cost of shipping and packaging.

Still other such devices relied on attachment mechanisms that projected relative to the brush head in a way such that they could have the holder portion of the wand contact the bowl. This created a risk of scratching certain bowl surfaces.

Further problems with some of the prior art replaceable brush heads included reliance on very tiny brush heads (thereby increasing the time needed to clean the bowl), or reliance on structures that were difficult to adequately quickly wet (thereby increasing the time needed to dispense impregnated chemical).

Still other devices could not be produced efficiently with automated equipment. With those, the cost of the devices were such as to make them less competitive in the marketplace.

As such, it can be seen that a need still exists for improved toilet brushes of the type having replaceable, disposable brush heads.

SUMMARY OF THE INVENTION

In one aspect the invention provides a brush head suitable to be held by a cleaning device (for example a toilet bowl brush). The brush head has a plurality of layers of a water-degradable material positioned on top of each other to form a stack of such layers.

In this patent "water-degradable" is intended to mean that the material tends, with the degree of mechanical action typical in residential plumbing systems, to structurally separate in water into pieces (preferably in numerous small pieces) in less than one month, preferably in less than one day, even more preferably in less than one half hour. "Water-degradable" is not intended to necessarily require any particular degree of biodegradability as distinguished from structural degradability, albeit for a variety of reasons biodegradability is also highly preferred.

While a variety of cellulosic materials have been developed for use as toilet paper, and toilet paper is water-degradable, stacked plies of conventional toilet paper are not optimal for our brush heads as they tend to degrade more quickly than desired when used for scrubbing a bowl surface in a water environment. Thus, it is preferred to use a nonwoven fibrous web formed from a blend of cellulosic fibers that are hydroentangled. See U.S. Pat. No. 4,755,421 for a disclosure of such hydroentangled materials.

It is most preferred to use a nonfibrous web which is at least 70% pulp fibers hydroentangled with other selected fibers. Suitable materials are available from Ahlstrom Corporation under the tradenames Hydraspun 784 Flushable Wipes, Hydraspun 8553 Flushable Wipes, Hydraspun 1280 Flushable Wipes, and Hydraspun 1280 Flushable Wipes Apertured Grade. The last of these materials is a somewhat more abrasive material than the other three. In one form one starts with a material having a dry thickness of about 500 microns. By forming a two-ply structure of that material one ends up with a thickness of about 1,000 microns.

Some of the brush heads of the present invention are formed from a single piece of water-degradable material that has been repetitively folded back on itself in accordion fashion. This is one form of a "stack" of material.

Another approach is to take shorter segments of that material, fold them over once, and then stack the folded over segments. Either approach creates a stack brush head that has at least two of its layers formed from a single sheet of the water-degradable material that has been folded back on itself.

In any event, it is preferred to have between four and forty layers of such material in the stack. Using less than four layers may provide a small brush head which takes longer to clean a typical toilet bowl. Using more than forty layers increases the production cost and (depending on the thickness of the layers) may increase the frequency of clogging the toilet or septic system.

To achieve any desired level of thickness of a particular layer, one can start with a sheet that is already that thick, or take multiple sheets of less thickness and (by pressing) create a multiple ply layer.

To provide for easier handling, clamping and removal of the brush head it is preferred that the end of the brush head opposite the bristles have the layers bonded together. One means of achieving this bonding is by pressure bonding (also known as mechanical quilting) of the type typically used to bond multiple plies of paper towels together. This has the advantage of avoiding the need for a gluing, stapling or stitching step. However, the pressure of the bonding may need to be carefully regulated to permit the layers to quickly separate under the flushing or septic conditions.

An alternative is to use a water-dissolvable attachment means applied to the brush head adjacent the end of the stack opposite the bristles. The attachment means could be a water-soluble adhesive such as adhesive H9397 (a hot melt adhesive sold by Bostik Findley). The attachment means could instead be water-dissolvable threads or staples made of a material such as polyvinyl alcohol.

When an adhesive is chosen for this purpose which is somewhat tacky after it dries, it is preferred to also use a separate water-dissolvable cover sheet positioned over a portion of the brush head to which the adhesive has been applied. The sheet can be made of the same material as the layers are, albeit preferably without impregnating chemical.

A further technique is for the cover to be an adhesive type label that both functions as the cover and applies the adhesive. This approach would avoid the separate step of applying the adhesive, and insure that any adhesive was covered by the cover.

Regardless of the technique for bonding the layers at the end of the head opposite the bristles, it is desirable that the head end be compressed such that at rest the bristle end will be between 50 and 200% thicker than the opposite end. When this is the case, the bristle end will tend to spread out the appropriate amount when pushed against the bowl side during a scrubbing motion.

It is preferred for the bonded section to constitute no more than one-third of the head axial length. Again, this permits two-thirds or more of the length to be used for bristles and spreading support therefor.

In another form, the invention provides a toilet brush head suitable to be held by a toilet brush handle. The brush head is made of agitation-degradable material that is nevertheless capable of essentially retaining its structural integrity for at least one minute when scrubbing a toilet bowl interior wall surface under water. "Agitation degradable" is intended to mean that the breakup time of a head, measured from beginning of agitation until the head is broken down into pieces all smaller than 2.54 cm in diameter, is less than thirty minutes, using the breakup measurement protocol of U.S. Pat. No. 4,117,187.

In highly preferred forms the brush head has been at least partially impregnated with a cleaning chemical such as a surfactant. The chemical can be a mixture of one or more of the surfactants known to be effective for toilet bowl or other cleaning (for example most preferably anionic and nonionic in combination, but also possible cationic or zwitterionic). The chemical composition can also include fragrance, dye (for example to dye the head itself or for turning the bowl water a desired color such as blue), preservatives, bleaches, and/or other additives conventional in toilet bowl cleaners (for example abrasives).

Most preferably, any such impregnating chemical has only a very low percentage, or no, water. For example, the chemical composition could, as applied, have less than 50% (or more preferably less than 30%) water. By using low levels of (or no) water in the cleaning chemical, the cleaner is inhibited from migrating during storage from the interior layers to the exterior layers. Further, the structural integrity of the brush is protected.

When applying the chemical composition, it is preferred that the interior layers be impregnated, but not the exterior layers. This allows the outside of the brush to be used for wiping the bowl outer sides and top rim without the need to rinse them. It also makes manual handling of the head during replacement of the head less likely to place the consumer in contact with cleaning chemicals. This also may facilitate packaging, clamping and/or unclamping.

In one aspect the cleaning chemical is placed only at a central portion of internal layers and is such that it does not migrate during storage to the edges of that layer. This has the added benefit that the entire exterior of the brush head may then be free of the chemical, permitting a consumer to contact the six (or at least five) outside surfaces of the head without contacting the chemical.

It should also be appreciated that certain layers could be impregnated with one chemical (for example a dye), while other layers are impregnated with another chemical (for example a bleach), where the two chemicals are normally incompatible in some way during long-term storage. The use of low water levels, or no water, could facilitate this as well.

Moreover, with exceptionally low levels of water, or no water, in the chemical(s) some layers could be impregnated with one chemical formula (for example a bicarbonate and a surfactant), and the other layer could be impregnated with another chemical formula (for example citric acid and a surfactant) such that the chemicals would react in the toilet bowl (for example to cause foaming).

In other preferred forms a plurality of the layers are formed with bristle segments adjacent the opposed end of the brush head. This can be achieved by simultaneously creating bristle segments through all the layers by cutting about half-way through the stack from one end in parallel cuts, using automated equipment. Each bristle could be single-layered, or more preferably be a double-layered structure in the form of a loop.

When using the preferred nonwoven materials, it has been discovered that by making the bristle cuts parallel to the cross machine direction of the material the automation process is facilitated. However, the exact direction of cutting is not critical.

In other preferred forms it is desirable to provide some form of recess and projection interfitting between the jaw and the brush head. Most preferred is a projection on the jaw interfitting with a recess formed on or in the brush head.

One example of this is an axial notch at the bound end of the head, such as a notch which tapers axially from an outer portion of the brush head towards a bristle portion of the brush head. A corresponding tongue can be formed on the wand that this brush head is used with so that the head is suitable to be centered laterally along the retaining jaw. Alternative structures would be through holes through the brush and corresponding peg-shaped projections of complementary cross section extending from the jaw.

Multiple brush heads can be stored in a bag together until use, or in other containers. Alternatively, a single brush head could be stored in a pouch that does not contain any other brush heads. The pouch could have a transverse tear line along its middle section so that the portion of the pouch above the bristles can be removed while leaving the other portion around the bristle section. This provides a consumer with a way of handling the brush head without contacting the brush head.

In another form the invention provides a wand for holding a brush head. The wand has a handle section having an internal axial cavity, a lower opening communicating with the cavity, and a radial opening communicating with the cavity above the lower opening. There is an actuator having a projection extending through the radial opening, a connecting rod linked to the projection which is mounted in the handle cavity, and a jaw linked to the rod which extends out the handle lower opening.

The wand is constructed and arranged such that a first movement of the projection (for example axially downward) will move the jaw to a first position suitable to release a brush head, and a second movement of the projection (for example axially upward) will move the jaw to a second position suitable to clamp a brush head. In preferred forms the handle has teeth that extend radially into the cavity and the connecting rod has radially outwardly extending teeth.

Preferably when the jaw is clamped on the brush head it will occupy less than one-third the lateral surface of the brush head. While greater coverage is possible, that will reduce the effective area of the brush bristle portion.

The handle teeth and rod teeth can interfit to inhibit at least one form of axial relative movement there between (absent a prior radial movement of the projection). In this regard, the handle teeth and rod teeth can be angled such that they more readily can inhibit relative axial movement there between in a first direction as compared to relative axial movement there between in a second direction opposed to the first direction.

There can be a spring positioned along the connecting rod to radially outwardly bias the projection, the rod having a portion with a cross-shaped cross sectional appearance. There can also be at least one outer contact ear formed on the jaw, and the projection, connecting rod and jaw can all be formed from a single integral piece of plastic material.

In other aspects of the invention the wand can be attached to a separately formed extension, the extension having a hanger hole.

In yet another aspect of the invention there is provided a toilet brush. It has a handle linked to a lower clamping jaw, and a brush head suitable to be held in the jaw. The brush head has a plurality of layers of a water-degradable material positioned on top of each other to form a stack of such layers.

In a preferred form of this variant, the jaw can be opened and closed by movement of a radially extending projection where the projection is remotely positioned on the handle from the position of the brush head. By "remotely" it is intended that the term mean more than 20% up the length of the handle.

Alternatively, the jaw can be opened and closed by movement of a lever positioned adjacent the position of the brush head.

It will be appreciated from the description above and the disclosure below and in the accompanying drawings that the present invention is capable of achieving a variety of advantages. For various embodiments these may include providing:

(a) a brush head that will maintain its integrity throughout a normal scrubbing period and then readily degrade once released into the water;

(b) a brush head that is inexpensive to produce (for example can be produced using automated equipment);

(c) a brush head that can be optimized for cleaning through use of multiple separated treatment regions on it;

(d) a brush head with a large surface contact region;

(e) a brush head that is suitable to be quickly wetted;

(f) a brush head that minimizes the tendency of the wand to accidentally scratch the bowl surface when the brush head is in place;

(g) a wand assembly that has few components and is operable in a readily understood manner;

(h) a wand assembly and associated storage system that can easily release a brush head and then easily and securely reattach a replacement head, without the consumer needing to contact the brush head;

(i) a wand assembly that reduces the likelihood of the brush head being accidentally dropped from the wand by a premature release of the brush head;

(j) a wand assembly that can be assembled from shorter length pieces, such that the wand parts can be shipped and stored for sale in smaller packaging than would be required for the assembled brush;

(k) a wand assembly and associated brush head which insure proper centering of the brush head and restrict use of inappropriate brush heads with the wand; and (l) a cleaning brush assembly which consumers will be likely to feel is sufficiently rigid to be used to vigorously scrub the sides of a toilet bowl interior wall.

These and still other advantages of the present invention will be apparent from a review of the following disclosure. In the description reference is made to the accompanying drawings which form a part thereof, and in which there is shown by way of illustration, and not limitation, preferred embodiments of the invention. These embodiments do not represent the full scope of the invention. Rather, reference should therefore be made to the claims herein for interpreting the scope of the invention.

BRIEF DESCRIPTION OF THE DRAWINGS

FIG. 10 shows how two plies of an absorbent and degradable material can be fed along an assembly line to create a two-ply sheet;

FIG. 11 depicts how an expanse of such a two-ply sheet can be folded in accordion fashion;

FIG. 12 depicts how an end of the FIG. 11 structure can be cut to create brush bristles;

FIG. 13 depicts how a nozzle can be inserted between accordion folds to inject a cleaning chemical, and how a cover sheet can be applied at an opposite end of the brush head;

DETAILED DESCRIPTION OF THE INVENTION

The present invention provides a toilet brush (or other cleaning brush) having a wand/handle that is an essentially permanent part (for example made of one or more durable hard plastic(s)). The toilet brush also has a brush head that is disposable and replaceable. In this regard, in the FIG. 1-9 embodiment there is depicted a toilet brush (generally 10) having a disposable brush head 11 and a multi-part wand/handle (generally 12).

Figure 2:
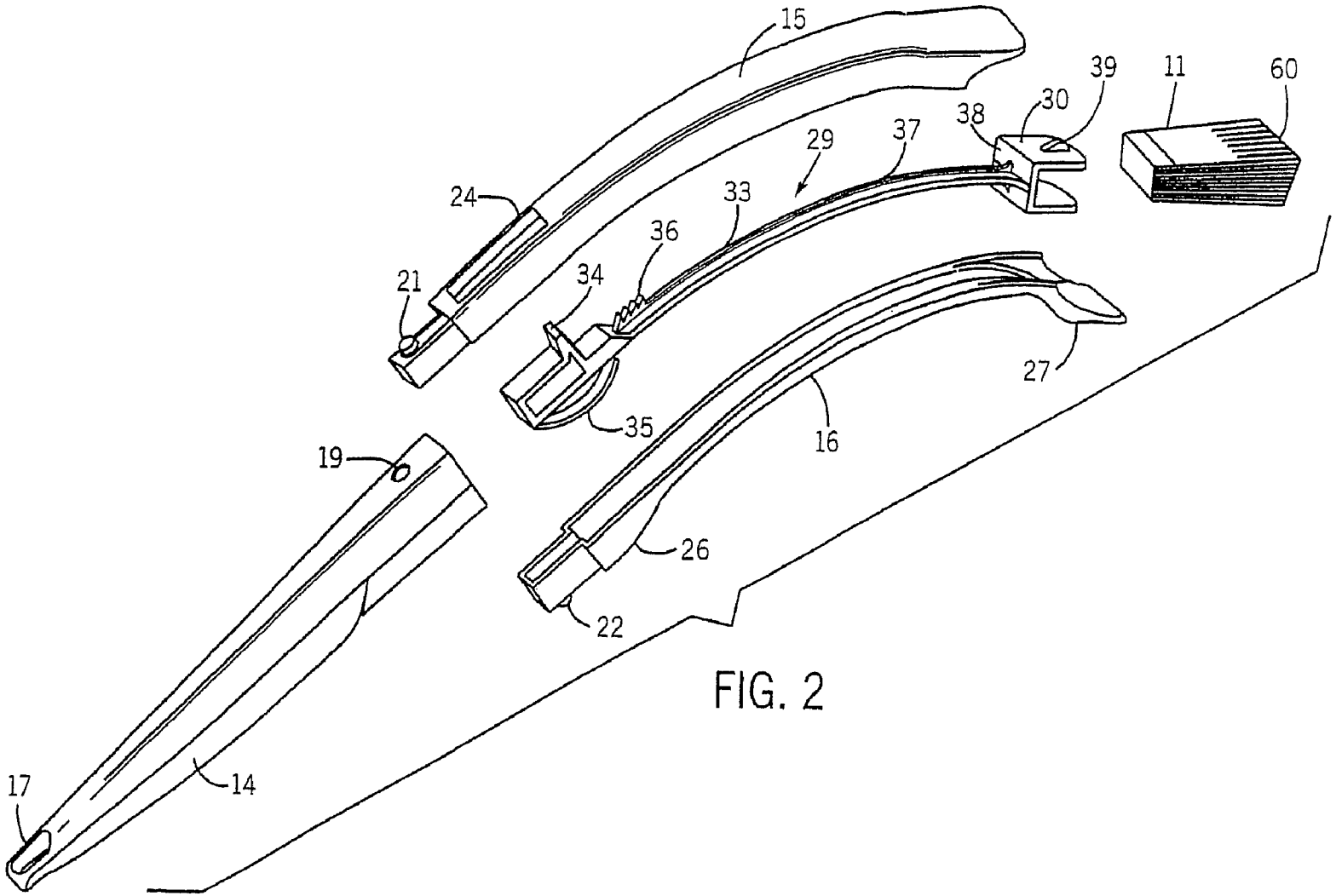
FIG. 2 is an exploded perspective view thereof, albeit taken from the left side.
Figure 3:
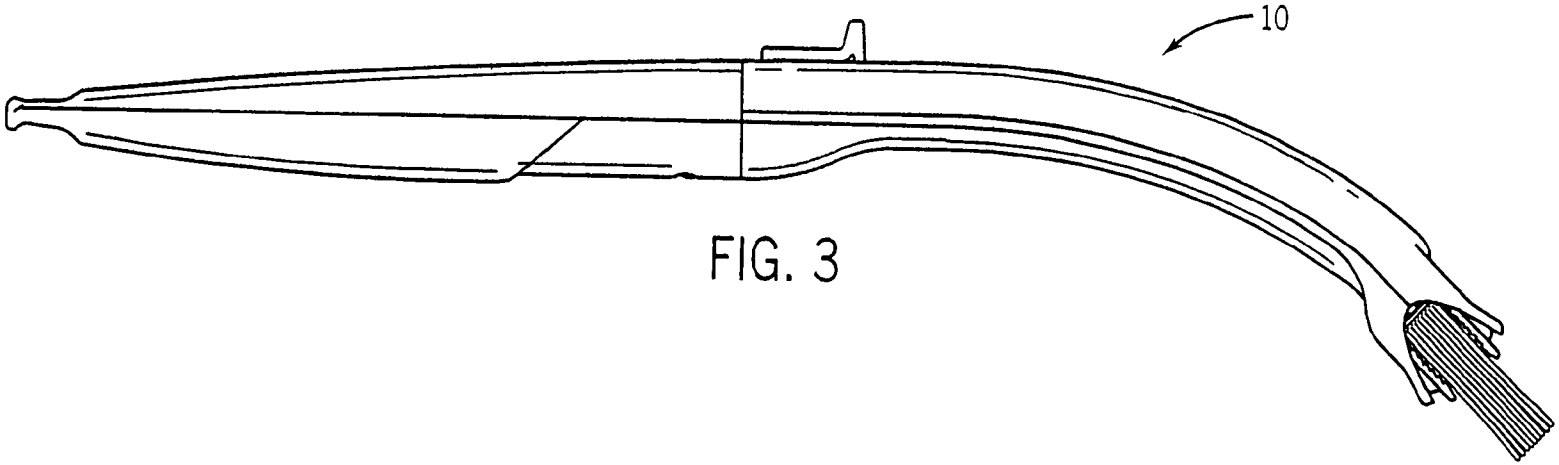
FIG. 3 is a left side elevational view of the FIG. 1 assembled brush.
Figure 4:
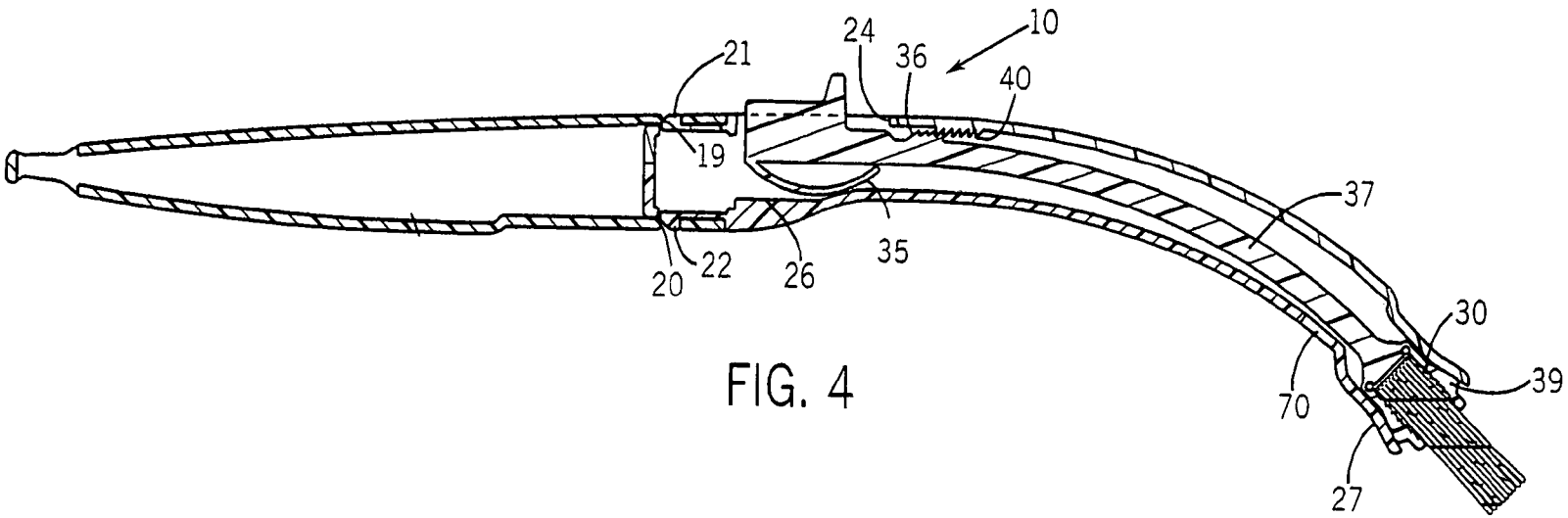
FIG. 4 is a cross sectional view taken along line 4-4 of FIG. 1.

As may be best appreciated from FIGS. 2 and 4, the wand 12 can be assembled from an extension 14, and upper and lower clam shell housing parts 15 and 16. The extension 14 is preferably largely hollow to reduce weight, and is formed with a hole 17 for assisting in hanging up the wand 12 (or the wand 12 with an unused brush head 11 connected thereto) between uses (for example on a nail or a hook).

Near the opposite end of the extension 14 are radially extending holes 19 and 20 that are suitable to receive corresponding snap parts 21 and 22 of the housing parts 15 and 16. The housing part 15 has a radial slot 24 on one surface and an arcuate inner channel along its opposite surface. The housing part 16 has a corresponding arcuate inner channel along its upper surface extending to a rear depressed area 26. When the housing parts 15 and 16 are assembled together they form a somewhat clam shell-like housing with a hollow internal cavity communicating with the slot 24 and a mouth outlet 25 at a lower end.

Prior to assembling the housing parts 15 and 16, an actuator (generally 29) is positioned there between. As shown in FIG. 2, the actuator 29 has a radially outward projecting section 34, a lower flexible spring 35, a series of catch teeth 36, a rod 37 (which is preferably of a cross-shaped cross section to reduce weight and friction), and a flexible jaw 38 having one or more abutment ears 39.

The projection 34 extends through the slot 24, with the spring 35 then abutting housing part 16. It will also be appreciated (for example from FIG. 5) that corresponding teeth 40 are formed on an internal surface of housing part 15.

Once the parts 15 and 16 have sandwiched the actuator 29, that subassembly can be snap fit into the extension 14 via the interaction of the parts 19, 20, 21 and 22. This creates a secure and rigid wand structure.

Figures 5, 6:
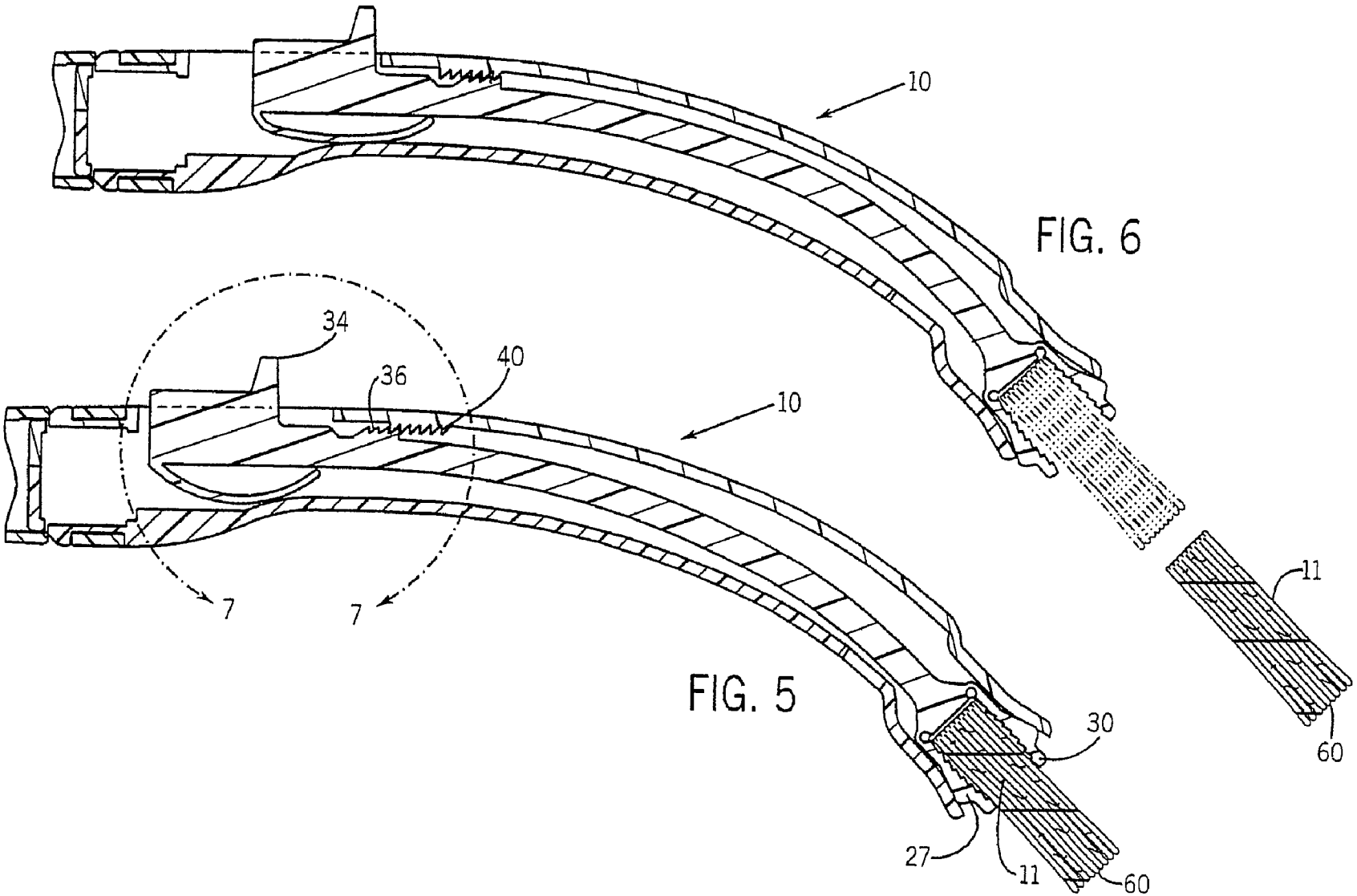
FIG. 5 is an enlargement of a portion of FIG. 4, showing the brush head in the clamped position.
FIG. 6 is a view similar to FIG. 5, but with the actuator moved such that the clamping jaw has flexed open to permit the release of the brush head.
Figure 7:
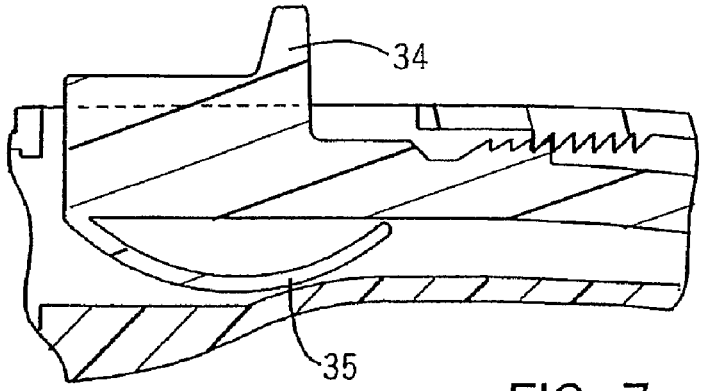
FIG. 7 is a further enlarged view of a portion of FIG. 5, as indicated by the line 7-7.
Figure 8:
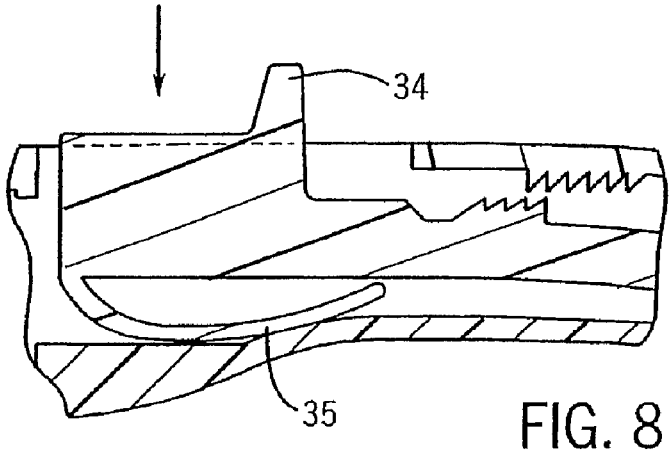
FIG. 8 is a view similar to FIG. 7, but showing how a projection portion of the FIG. 7 assembly can be pressed downward to free the connecting rod of the present invention from its interlocking with the handle.

When the projection 34 is in the FIG. 5 position, teeth 36 are interfit with the teeth 40 such that downward movement of the connecting rod 37 is inhibited. In this position the upper and lower jaws 30 have been driven by the mouth 25 firmly against the upper portion of the brush 11 of the present invention. If desired, these jaws can also be provided with teeth (for example compare the jaws of FIG. 20), albeit this is not critical for most applications.

Figure 9:
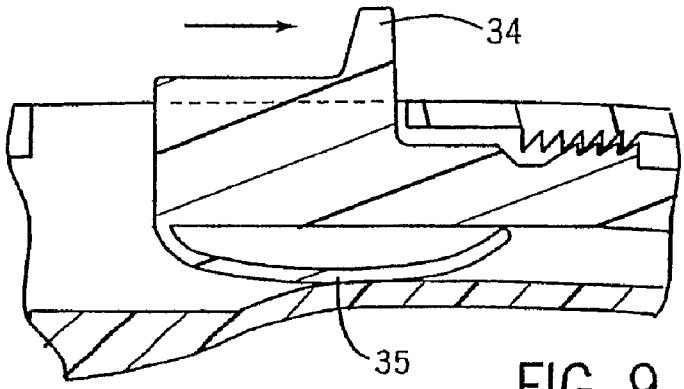
FIG. 9 is a view similar to FIG. 8, but showing how once the parts have reached the FIG. 8 position and the connecting rod has been further moved, a spring can hold the connecting rod at a particular axial position.

In this configuration the jaws firmly hold the brush head 11, and the control rod 37 is inhibited from accidentally moving in a way that would permit release of the brush head. However, when a consumer pushes radially inward on the projection 34 (compare FIGS. 7 and 8) against the opposing spring pressure, the teeth 36 and 40 will clear each other (see FIG. 8) such that a consumer can then readily push the projection 34 axially towards the handle mouth. Subsequent release of the projection permits the teeth to re-engage as shown in FIG. 9, thereby holding the jaw in the FIG. 6 position.

The actuator 29 is preferably molded from a plastic such as polypropylene which holds a position bias. The jaws can be molded with a rest position that is more open than shown in FIG. 6. When the jaws are dragged into the wand mouth 25, they will tend to flex towards each other as shown in FIG. 5. However, even a slight release of the wand holding pressure, as shown in FIG. 6, will allow the jaw to flex open, thereby releasing the brush head.

It is expected that the brush head will then be able to easily fall out of the jaw into the toilet bowl for flushing disposal. However, if the brush head tends to hold in place, one can lightly shake the brush head to dislodge it.

When it is desired to reclose the jaw to clamp a replacement brush head, simple axial movement of the projection 34 (without any depressing of it) will achieve this due to the particular sloping of the teeth. Thus, a unidirectional movement of the projection is sufficient to catch a new brush head, while a bidirectional movement is required to create a release. This helps avoid accidental release of the brush head, while making insertion of the replacement brush head easy and intuitive.

Turning now to FIGS. 10-13, another aspect of the invention is in the structure of the brush head. In a preferred form of the brush head, a double-ply sheet of brush material 50 is formed from two rolls 51 and 52 of one of the Hydraspun sheets described above.

As shown in FIGS. 11-13, the sheet can be folded in accordion fashion with a highly concentrated cleaning/fragrancing material being injected between a number of the internal switchbacks 55 and 56, but preferably not between the outer switchbacks 53 and 54.

One preferred example of a cleaning chemical for such impregnation contains about 63% of surfactant (about 15% lauramide DEA; about 28% sodium lauryl sulfate; about 20% of sodium dodecylbenzene sulfonate), about 25% water, about 10% perfume, and about 2% of various other ingredients such as dye and preservative.

Once a tight accordion structure has been formed, about one-half of the length of the resulting block stack can be cut as shown in FIG. 12 to create a bristle section 60 and a gripping/adhesion section 61. The section 61 can then be press bonded, or alternatively stitched or stapled with a water-degradable material (not shown). Alternatively, that portion can be coated with a water-dissolvable glue. In any case, the idea is to prevent the section 61 from spreading open prior to the brush head being ejected after use.

Some water-dissolvable glues are tacky or sticky even after they "dry" or "set". This could be of concern to a consumer who might touch that material, or cause the brush head to stick in place when release is desired. Thus, we show in FIG. 13 that one can take a short piece of the same material used for the brush layers and create a three-sided cover 57 around the glued end 58.

It should be appreciated that the resulting construction of the bristles takes up a considerable volume, particularly when the brush bristle section is spread somewhat during use. However, each layer is quite narrow, and thus the overall device will readily degrade after being flushed, particularly after the stack opens up.

Note also that a radial drain hole 70 (see FIG. 4) is placed in the lower region of part 16. Should any liquid seep into the wand cavity above the brush head, it will quickly drain out through this hole.

Figure 14:
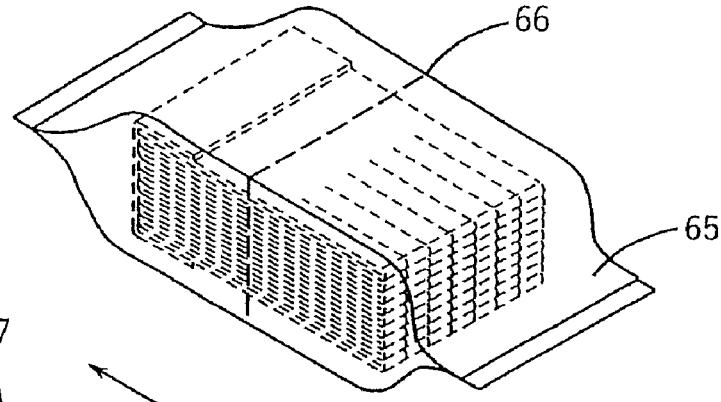
FIG. 14 depicts a top right perspective view of a pouch enclosing a brush head of the present invention.
Figure 15:
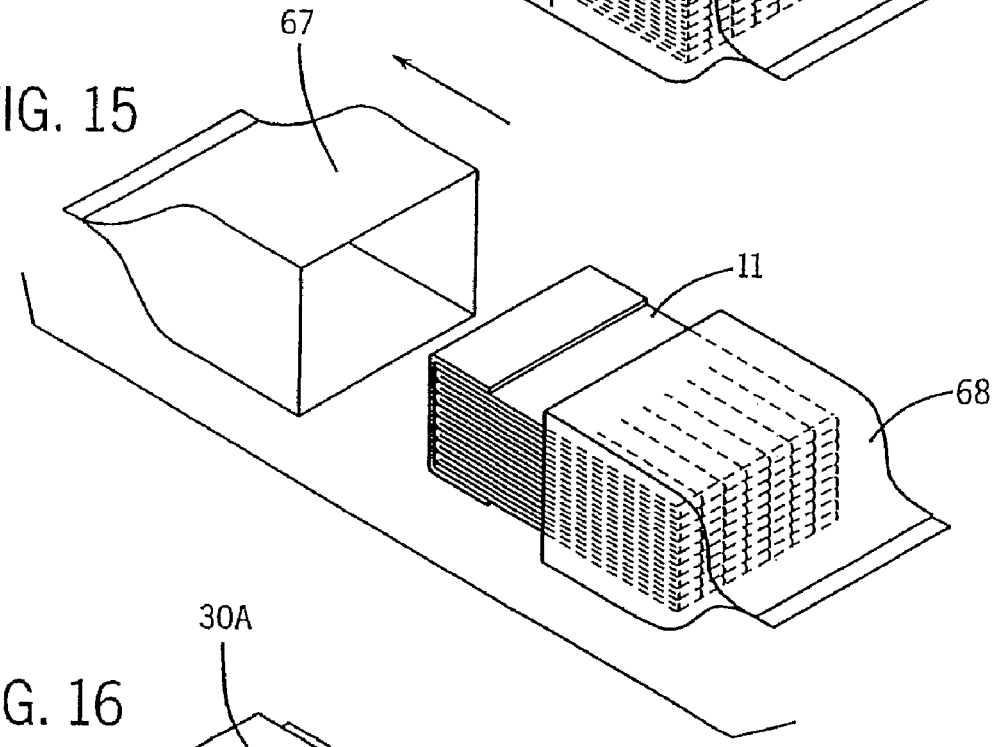
FIG. 15 is similar to FIG. 14, but with part of the pouch pulled apart.
Figure 16:
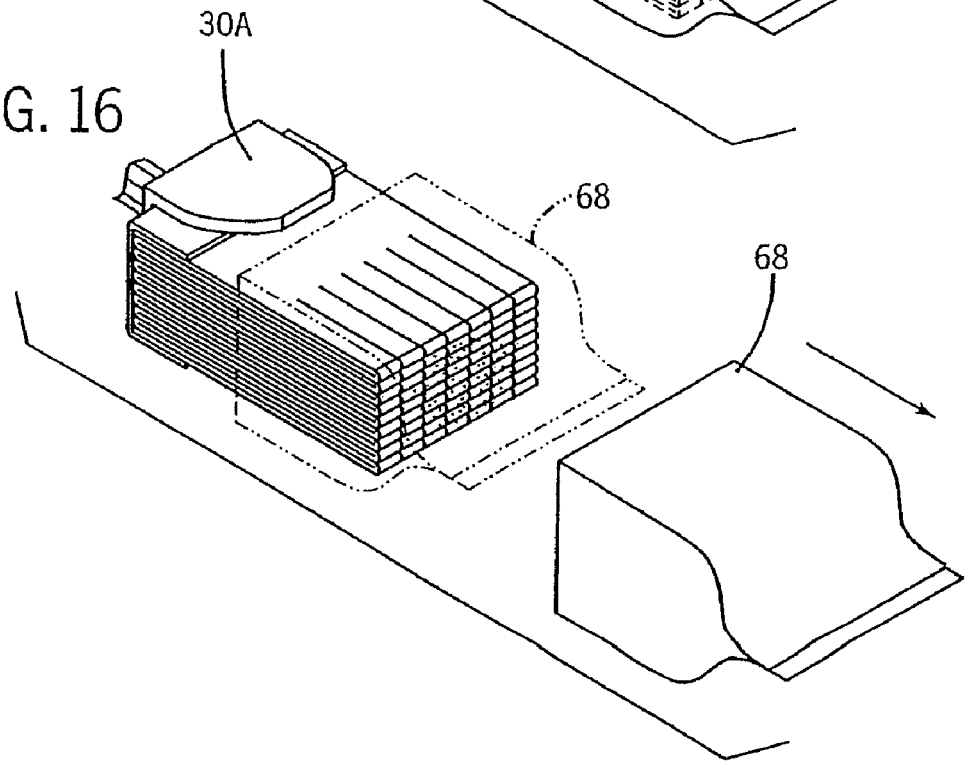
FIG. 16 is similar to FIG. 15, but showing the brush head in the process of being inserted into a clamping jaw of the present invention.

Turning next to FIGS. 14-16, one mode of storing the brush heads is to package each in a pouch 65 having a weakened tear line 66 around its lateral circumference. When the pouch is separated along that line the portion 67 can be removed and the consumer can leave the section 68 on the brush head as a form of temporary handle for manipulating the brush head into a jaw 30A.

Once that jaw 30A has closed on the brush head, the remaining pouch part 68 can be disposed of. This permits the brush head to be installed without a consumer needing to contact the brush head.

Regardless of the mode of storage of the replacement brush heads, the concept is to place a brush head in the jaw and clamp it in place. This creates a toilet brush suitable for cleaning conventional toilets and other like surfaces.

Note that the outside of the toilet could first be wiped by the detergent-free surface 61 of the outer layer. Then, the interior of the bowl could be wiped and cleaned in the usual manner, except that the cleaner would (at least to some extent) be supplied from the brush head itself. This could also dispense into the water an aesthetic coloring dye (for example blue) or a perfume scent.

After removing the vast majority of resistant scum from the sides of the toilet bowl interior, the toilet could be flushed for a first rinse. The remainder of the resistant scum could then be brushed off by further scrubbing. Then, a consumer would then push the projection 34 radially inwardly and then axially to permit a spreading of the clamping jaws. This would then be likely to cause the brush head 11 to be freed. In this regard, it will either easily fall off into the bowl water, or do so after one gently bangs the brush head against the underside of the bowl rim.

Figure 17:
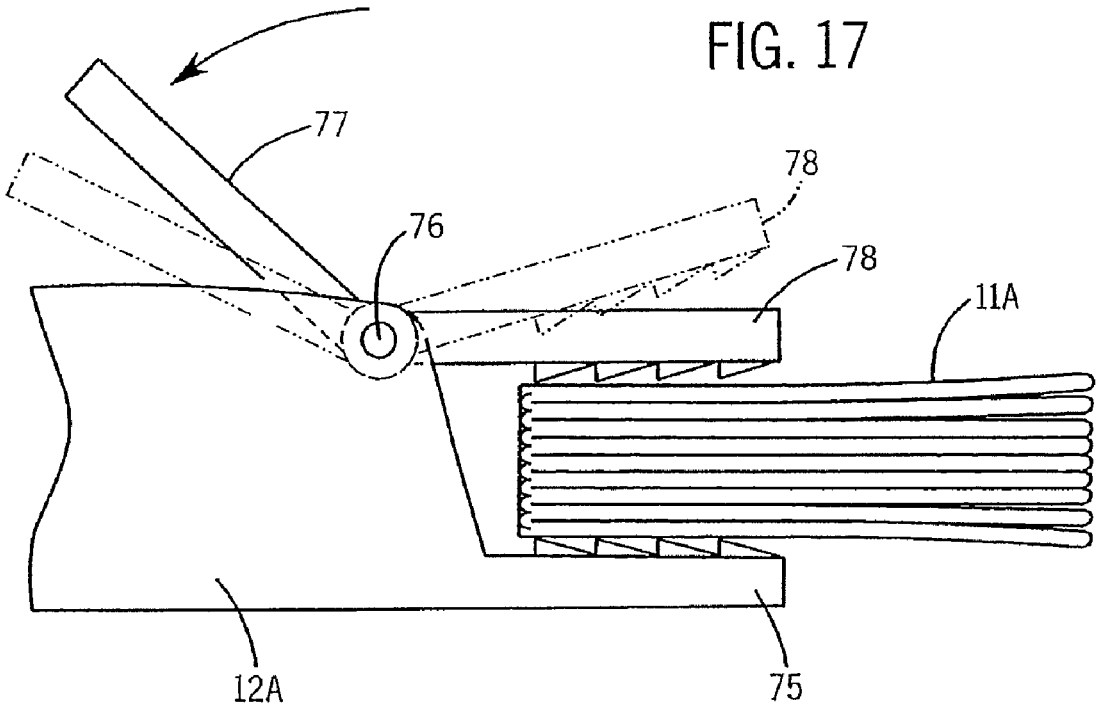
FIG. 17 is a left side elevational view of a lower portion of a second embodiment of the present invention.
Figure 18:
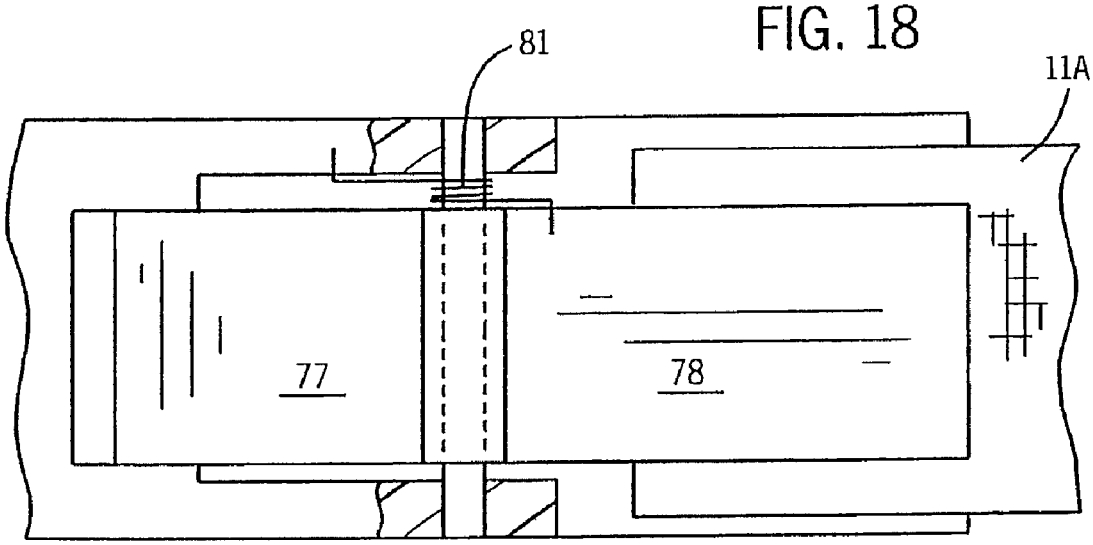
FIG. 18 is a plan view, partially fragmented, of a portion of the FIG. 17 device.

Numerous other changes can be made to the cleaning brush without departing from the spirit or scope of the claims. For example, FIGS. 17 and 18 depict another approach where the jaw is not activated by an internally movable rod. Rather, the wand has a bottom end 12A formed with a hinge hole 76 and an integral jaw part 75.

There is also a second, clothes pin-like jaw 78 mounted on the hinge hole 76 for movement in response to lever 77, and biased against that movement by a spring 81. This clamps onto a brush head 11A formed without a cover like cover 57. Similarly, head 11 could have been formed without such a cover.

However, in this last embodiment the activating system is positioned adjacent the brush head so that the wand structure can be much simpler (for example a simple stick at its upper end). With this embodiment pivoting of the lever 77 moves jaw part 78 away from jaw part 75, causing a release of the brush head 11A.

Figure 19:
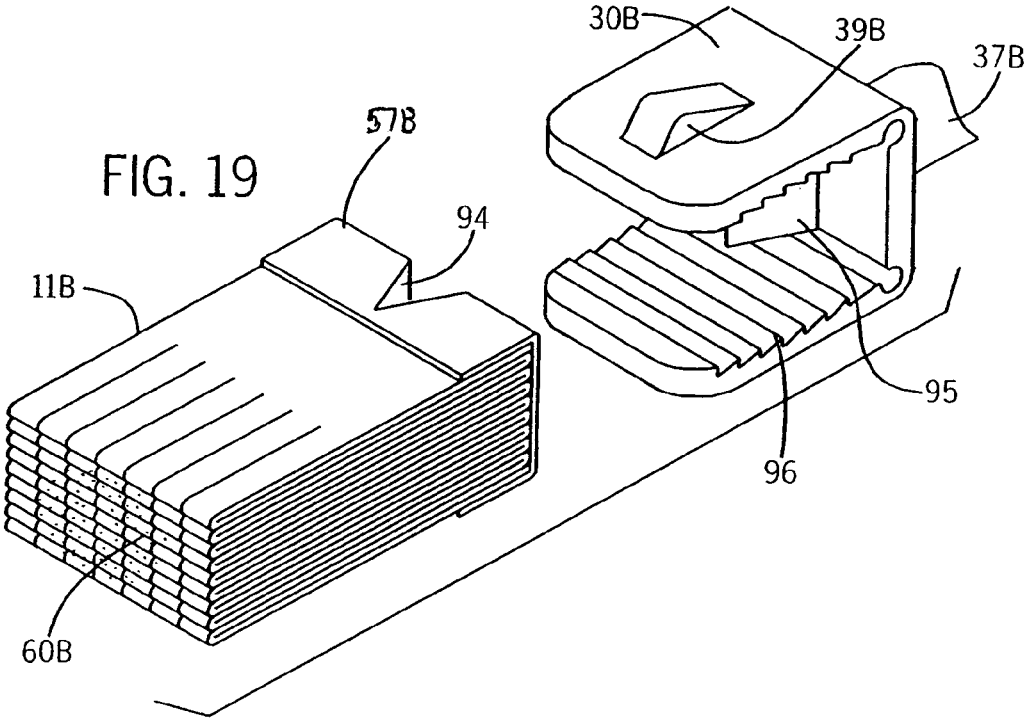
FIG. 19 is an exploded perspective view of a portion of a third embodiment of the invention, in which the jaw is provided with a tongue and the brush head is provided with a corresponding receiving slot.
Figure 20:
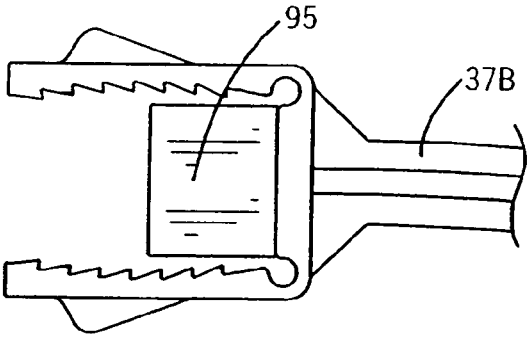
FIG. 20 is a right side elevational view of a portion of a clamping jaw and associated connecting rod, suitable for use with the FIG. 19 brush head.
Figure 21:
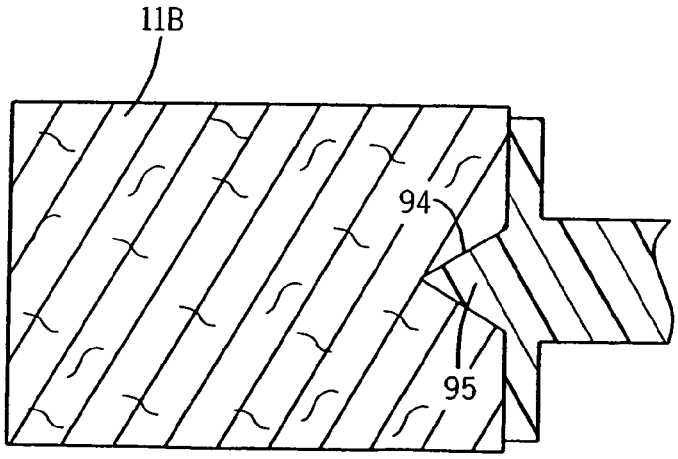
FIG. 21 is a schematic view depicting how the FIG. 19 brush head interlocks with the FIG. 19 jaw tongue.

In yet another alternative embodiment as shown in FIGS. 19-21, a brush head 11B having bristles 60B and covering sheet 57B is provided with an axial groove 94, preferably in the form of a triangular notch. The actuator structure is similar to that previously shown with jaws 30B, a connecting rod 37B and an abutment ear 39B. However, here the jaws are provided with angled grab teeth 96 and the jaw has connected to it a triangular tongue 95.

This construction serves to more accurately center the brush head 11B with respect to the jaws. It also has the benefit of inhibiting the use of inappropriate replacement heads with the design. For example, if a consumer attempted to insert a rectangular block sponge in the device, the projection would inhibit a solid connection between the parts and give the consumer a warning of the inappropriateness of the replacement head. This is particularly important because if a consumer attempted to flush an inappropriate replacement head, that could clog the plumbing, leading to dissatisfaction with the overall product.

Yet another alternative approach, not specifically shown, is to take shorter pieces of the water-degradable material to create multiple folded over pieces. The separate folded over pieces could then be stacked, with the resulting stack being processed as shown in FIGS. 12 and 13.

This alternative approach may have certain advantages that may merit the likely higher cost of production relative to the switchback construction. In this regard, once the glue or stitching dissolves, or the mechanical bonding becomes unbonded, the shorter folded over structures will already be split into multiple separate pieces, thereby expediting water-degradability. Further, this embodiment may be somewhat easier to use when one wants to selectively coat particular layers with different chemicals.

Yet another alternative embodiment (not shown) is to facilitate scrubbing by including an abrasive in the impregnating chemical, or by using as some of the outer plies a different material having a more abrasive nature. In this regard, one could place the Hydraspun Apertured Grade in the outside layers, and the Hydraspun other wipes in the internal layers.

Moreover, the brush head could be altered in other ways. For example, the degradable material could be separately dyed for aesthetic reasons before forming the brush, or could be impregnated with Bitrix or another known bittering agent that will cause a child to immediately spit out the brush head if the child tries to chew on it.

Figure 1:
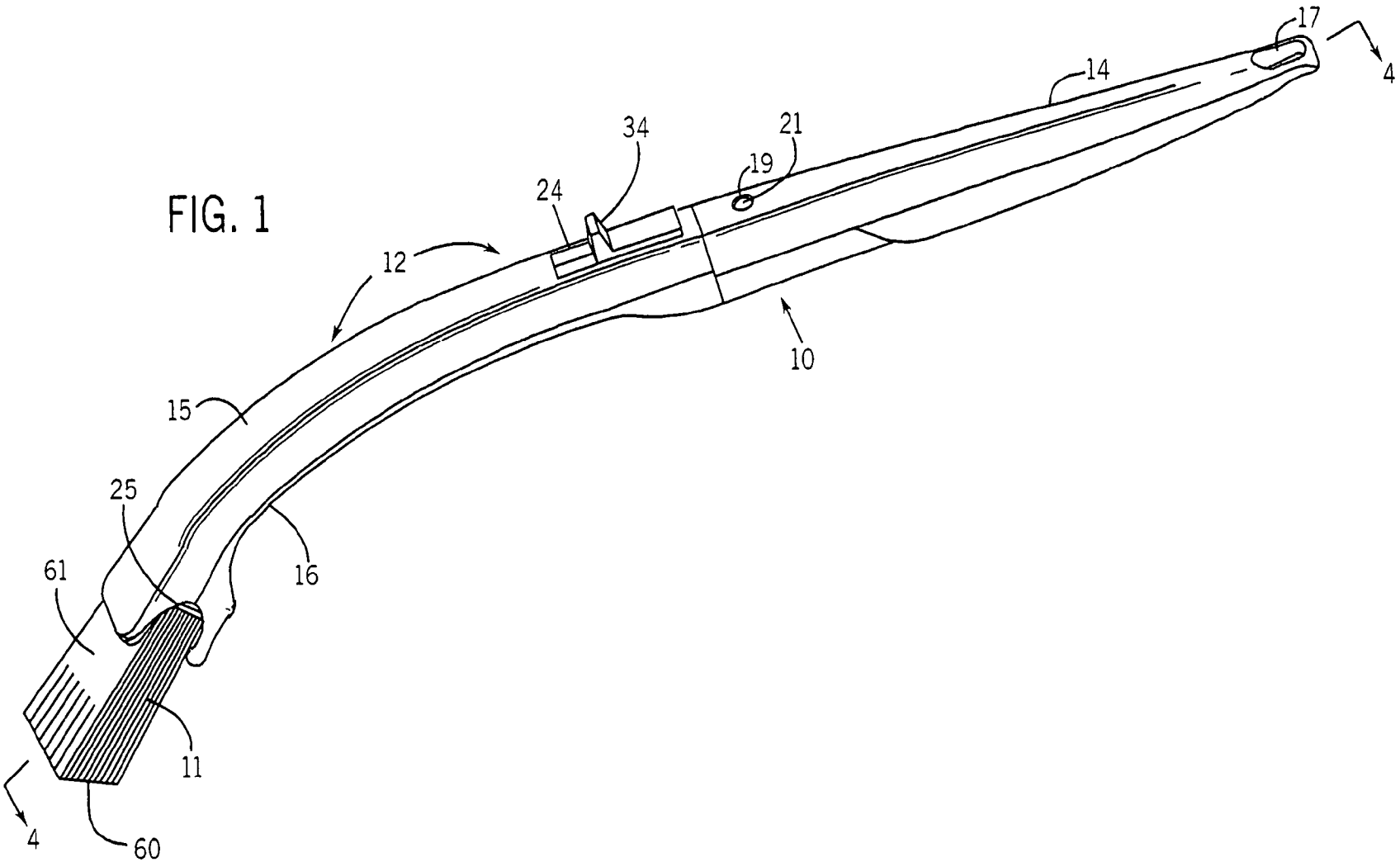
FIG. 1 is a top, frontal, right perspective view of a fully assembled cleaning brush, in the form of a toilet brush, in accordance with the present invention.

With respect to the wand, the FIG. 1 structure could be modified such that the rod is linked not only to the brush head, but also to a lower jaw. Further, a variety of other mechanical means can be provided to cause motion of the internal connecting rod. For example, a lever can be provided near where the projection is so that movement of the lever axially drives the connecting rod. Alternatively, various types of twisting or turning motions of the handle extension or other related part could (through appropriate linkages such as cams) drive the connecting rod back and forth.

Further, while the drawings show the rod projection and jaw as a single piece, the jaw could be formed as a separate piece hinged to the rod. Further, a spring or other means could be supplied adjacent the hinged jaw part to open that jaw part when not in the handle mouth.

The wand parts 14-16 are preferably made of plastic. It is especially preferred that a more flexible plastic be used for actuator 29 than for the outer parts 14-16. For the outer parts 14-16, a plastic such as ABS (for example MG38 available from General Electric) is preferred.

It should also be noted that while parts 14-16 are shown as being linked together by a snap fit connection of a type conventional with vacuum cleaner hose parts, a variety of other mechanical means for securing the parts together are possible. For example, there may be some benefits to the use of a bayonet type connection, rather than a simple axial snap connection. Alternatively, the parts 14-16 could be reconfigured as a two-part clam shell, albeit this would be less preferred due to it taking up extra shelf and shipping space prior to purchase by the consumer.

Also, while teeth 36/40 are angled to render clamping of the brush head easier to achieve than release, the teeth could be otherwise angled. For example, rendering them normal to the wand would make it equally difficult to move the connecting rod 33 in either direction, and require radial motion for both to proceed.

As such, one skilled in the art will readily apprehend that still other alternative embodiments fall within the scope and breadth of the invention. Thus, the claims should be looked to in order to understand the full scope of the invention, and the claims are not to be limited to just the preferred embodiments shown.

INDUSTRIAL APPLICABILITY

An improved toilet brush or the like is disclosed where a brush head is provided that is disposable and replaceable.

The invention claimed is:

1. A toilet brush head suitable to be held by a toilet cleaning device, wherein the brush head consists essentially of a plurality of layers of a water-degradable nonwoven material where the material comprises at least 70% pulp fibers entangled with other fibers, and the layers are positioned on top of each other to form a stack of such layers in a manner that the brush head is suitable to be flushed down a flush toilet;

wherein the plurality of layers are held together by a bond between the layers that is water degradable if the brush head is flushed down a flush toilet, wherein the bond is adjacent a first end of the stack and is formed without the use of any of glue, a staple or stitching to cause them to be held them together, and an opposed end of the stack in the form of bristles can spread out between at least some of the layers of the stack;

wherein the toilet brush head comprises between four and forty layers of material in the stack;

wherein at least two of the bristles of the toilet brush head each comprise a double-layered structure in the form of a loop;

wherein a first such loop is stacked over a second such loop with a rearward end of the first loop bonded to a rearward end of a second such loop to restrict the rearward ends of the loops from spreading apart from each other;

wherein the brush head has been at least partially impregnated with a chemical composition comprising a surfactant; and wherein the head is stored in a pouch having a weakened line along its middle section such that opening the pouch along the line will define a handle portion of the pouch and a removed portion of the pouch with a portion of the head projecting out of the handle portion of the pouch, while the handle portion provides a handle for aligning the head relative to the device when the removed portion has been separated from the handle portion.

2. The toilet brush head of claim 1, wherein the chemical composition further comprises water.

3. The toilet brush head of claim 1, wherein the toilet brush head is agitation degradable.

4. A toilet brush head suitable to be held by a toilet cleaning device, wherein the head is stored in a pouch having a weakened line along its middle section such that opening the pouch along the line will define a handle portion of the pouch and a removed portion of the pouch with a portion of the head projecting out of the handle portion of the pouch, while the handle portion provides a handle for aligning the head relative to the device when the removed portion has been separated from the handle portion wherein the brush head consists essentially of a plurality of layers of a nonwoven material positioned on top of each other to form a stack of such layers in a manner that the brush head is suitable to be flushed down a flush toilet;

wherein the plurality of layers are held together by a bond between the layers that is water degradable if the brush head is flushed down a flush toilet, wherein the bond is adjacent a first end of the stack and is formed without the use of any of glue, a staple or stitching to cause them to be held them together, and an opposed end of the stack in the form of bristles can spread out between at least some of the layers of the stack;

wherein the toilet brush head comprises between four and forty layers of material in the stack;

wherein at least two of the bristles of the toilet brush head each comprise a double-layered structure in the form of a loop;

wherein a first such loop is stacked over a second such loop with a rearward end of the first loop bonded to a rearward end of a second such loop to restrict the rearward ends of the loops from spreading apart from each other;

wherein the brush head has been at least partially impregnated with a chemical composition comprising a surfactant; and wherein the nonwoven material is water degradable.

5. A toilet brush head suitable to be held by a toilet cleaning device, wherein the brush head consists essentially of:

a plurality of layers of a nonwoven water-degradable material where the material comprises at least 70% pulp fibers entangled with other fibers, and the layers are positioned on top of each other to form a stack of such layers in a manner that the brush head is suitable to be flushed down a flush toilet;

wherein the plurality of layers are held together by a bond between the layers that is water degradable if the brush head is flushed down a flush toilet, wherein the bond is adjacent a first end of the stack and is formed without the use of any of glue, a staple or stitching to cause them to be held together, and an opposed end of the stack in the form of bristles can spread out between at least some of the layers of the stack;

wherein the toilet brush head is agitation degradable;

wherein a first such bristle is stacked over a second such bristle with a rearward end of the first such bristle bonded to a rearward end of a second such bristle, to restrict the rearward ends of the bristles from spreading apart from each other;

wherein the brush head has been at least partially impregnated with a chemical composition comprising a surfactant and water; and wherein the head is stored in a pouch having a weakened line along its middle section such that opening the pouch along the line will define a handle portion of the pouch and a removed portion of the pouch with a portion of the head projecting out of the handle portion of the pouch, while the handle portion provides a handle for aligning the head relative to the device when the removed portion has been separated from the handle portion.

6. The toilet brush head of claim 5, wherein the toilet brush head comprises between four and forty layers of material in the stack.

7. The toilet brush head of claim 5, wherein each bristle of the toilet brush head comprises a double-layered structure.

8. The toilet brush head of claim 7, wherein the double-layer structure is in the form of a loop.

* * * * *